United States Patent [19]

Nugent

[11] 3,986,671

[45] Oct. 19, 1976

[54] SPRAYING APPARATUS

[76] Inventor: Robin Olivier Nugent, 8 Marriott St., Coorparoo, Queensland, 4151, Australia

[22] Filed: July 10, 1975

[21] Appl. No.: 594,864

[52] U.S. Cl. ..... 239/230; 239/233

[51] Int. Cl.[2] ..... B05B 3/00

[58] Field of Search ..... 239/230–233, 239/236, 263, 265, 382, 383

[56] References Cited

UNITED STATES PATENTS

| | | | |
|---|---|---|---|
| 3,791,585 | 2/1974 | Warren | 239/265 |

FOREIGN PATENTS OR APPLICATIONS

| | | | |
|---|---|---|---|
| 163,781 | 8/1949 | Austria | 239/230 |
| 1,480,294 | 5/1967 | France | 239/233 |
| 488,325 | 12/1953 | Italy | 239/233 |

*Primary Examiner*—John J. Love

*Attorney, Agent, or Firm*—DeLio and Montgomery

[57] ABSTRACT

A water sprinkler having a discharge axis inclined to the support axis, flow deflecting means biased for movement to a position for engaging the jet of water to deflect the same and to cause rotation of a nozzle in the opposite direction about the axis, and including a deflecting blade and driving vane, all to provide an even fall-out of water around the periphery of the watered circle.

12 Claims, 4 Drawing Figures

SPRAYING APPARATUS

This invention relates to irrigation sprinklers, and in particular, it relates to such sprinklers which rotate and eject a jet of water for watering a circular area or a predetermined sector thereof.

In the past, many such sprinklers have been provided. Commonly, such sprinklers comprise a nozzle which is adapted to discharge a stream of water in a substantially radial direction while rotating about a substantially vertical pivot axis. Rotation of the nozzle is achieved by swinging a deflector plate associated with the nozzle into the path of the water jet stream so that the resultant change of direction of the water jet stream upon impingement thereagainst will sequentially cause the nozzle to react by rotating around its pivot axis and the deflector plate to swing out of the water stream. Thus the nozzle rotates in small increments. The deflector plate is normally spring urged into engagement with the water jet stream so that the incremental rotation continues as long as the device is in operation.

Commonly, such deflector plates are weighted to effect the desired rate of rotation of the nozzle and if the rate of rotation has to be varied the weight of the deflector plate is varied. In other arrangements parts having a different geometry are substituted to achieve the desired effect. Also, other adjustment means are provided but generally adjustment requires complex manipulation and interchanging of parts. Thus, it is normally necessary to have a range of parts available for adjustment purposes and such parts do not give infinite adjustment but adjustment in fixed increments. This is a disadvantage of the presently available sprinklers as in use, a farmer, say, has to carry the spare adjustment parts with him on his rounds in case adjustment to any one spray nozzle is required. Also to achieve the desired adjustment, the farmer may have to add or delete parts on a trial and error basis and the time expended on adjusting the apparatus can be considerable.

Furthermore, in many of the earlier sprinklers of the above type, the majority of the water fall-out occurred in a narrow band around the periphery of the watered circle. The disadvantages of such watering are obvious and arise because of the coherent form of the water jet emitted from the apparatus in order to achieve the desired watering radius.

It is an object of this invention to provide a sprinkler which will overcome the above disadvantages by effectively dispersing the water jet to provide a more even fall-out over the entire watering circle and which will be readily adjustable so that an operator may control the watering effect to suit the particular conditions. It is also an object of this invention to provide such an assembly in which the trajectory of the water spray may be easily varied without the need to interchange parts. Other objects and advantages of the invention will become apparent from the following description.

With the foregoing and other objects in view, this invention resides broadly in a sprinkler having a water inlet housing supporting an outlet nozzle assembly thereon for pivotal movement about a substantially vertical support axis, said outlet nozzle assembly communicating operatively with said housing in such manner that water supplied to said housing is discharged through said outlet nozzle assembly as a jet of water having a discharge axis inclined to said support axis;

flow deflecting means supported on said outlet nozzle assembly and biased for movement to an engaged position in which said deflecting means engages the water jet to deflect same in a sideways direction causing rotation in the opposite forward direction of said nozzle about said support axis and said deflecting means being movable to a disengaged position in which said deflecting means is remote from said water jet, said flow deflecting means including a deflecting blade having a deflecting face for causing said sideways deflection of said water jet and driving vane means adapted to engage the water jet simultaneously with said deflecting face and associated with the latter in such manner that movement of said driving vanes resultant from engagement with said water jet causes movement of said deflecting means through said water jet from said engaged position to said disengaged position.

Preferably, said driving vane means comprises a plurality of vanes each in operation being arranged to sequentially engage said water jet to cause movement of said deflecting face and there being provided vane adjustment means for varying the number of vanes which will in operation engage the water jet, whereby the time of engagement between said deflecting means and said water jet may be varied.

Furthermore, it is preferred that said deflecting means is mounted on the free end of a pivot arm for movement between said engaged and disengaged positions and said pivot arm when supporting said deflecting means in said engaged position being restrained against forward rotation relative to said outlet nozzle assembly whereby when said deflecting means is in said engaged position, said pivot arm and said outlet nozzle rotate in unison in a forward direction about said support axis, and said pivot arm being free to pivot relative to said nozzle assembly in the reverse direction to said disengaged position.

In order that the invention should be more readily understood and put into practical effect, reference will now be made to the accompanying drawings which illustrate a preferred embodiment of the present invention and wherein.

Figure 1:
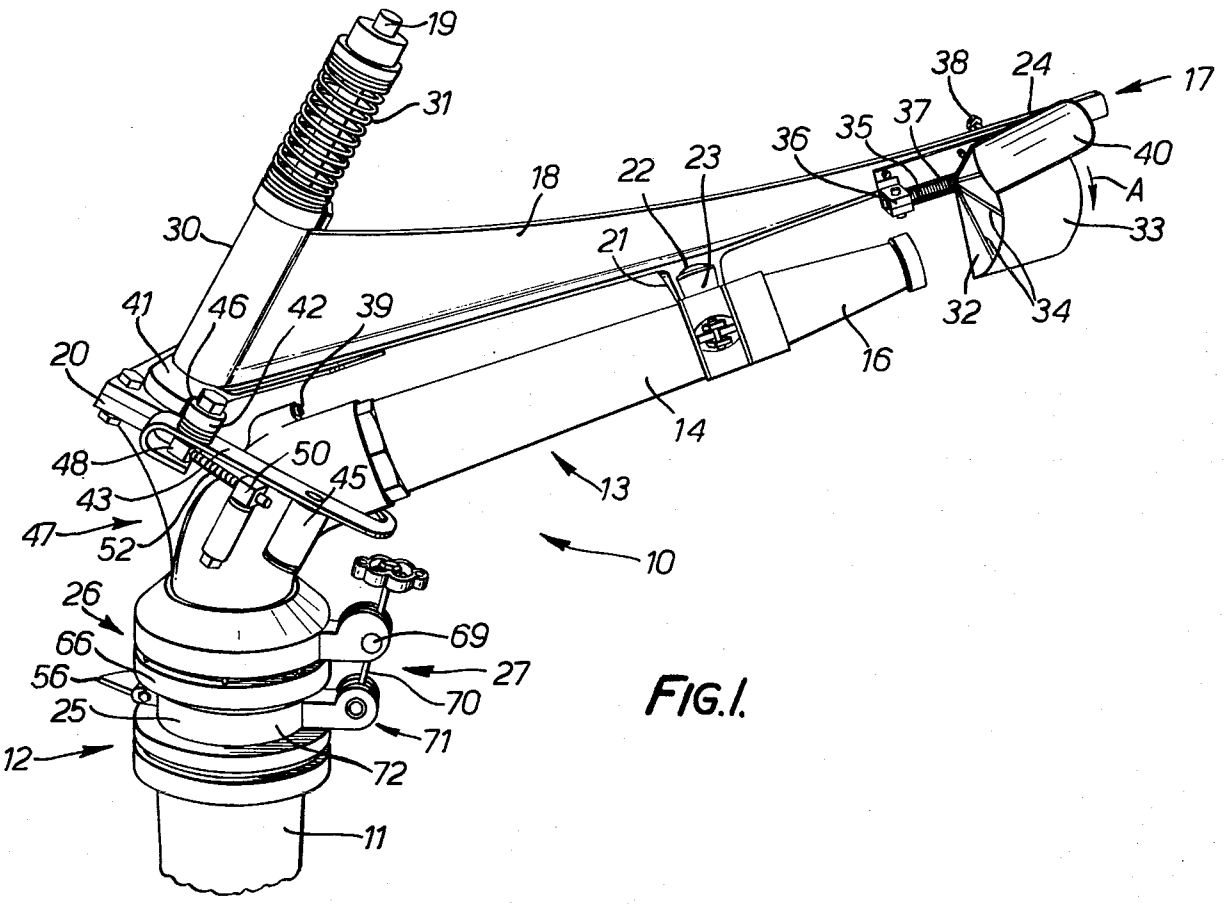
FIG. 1 is a perspective view of an irrigation sprinkler made in accordance with the present invention.
Figure 2:
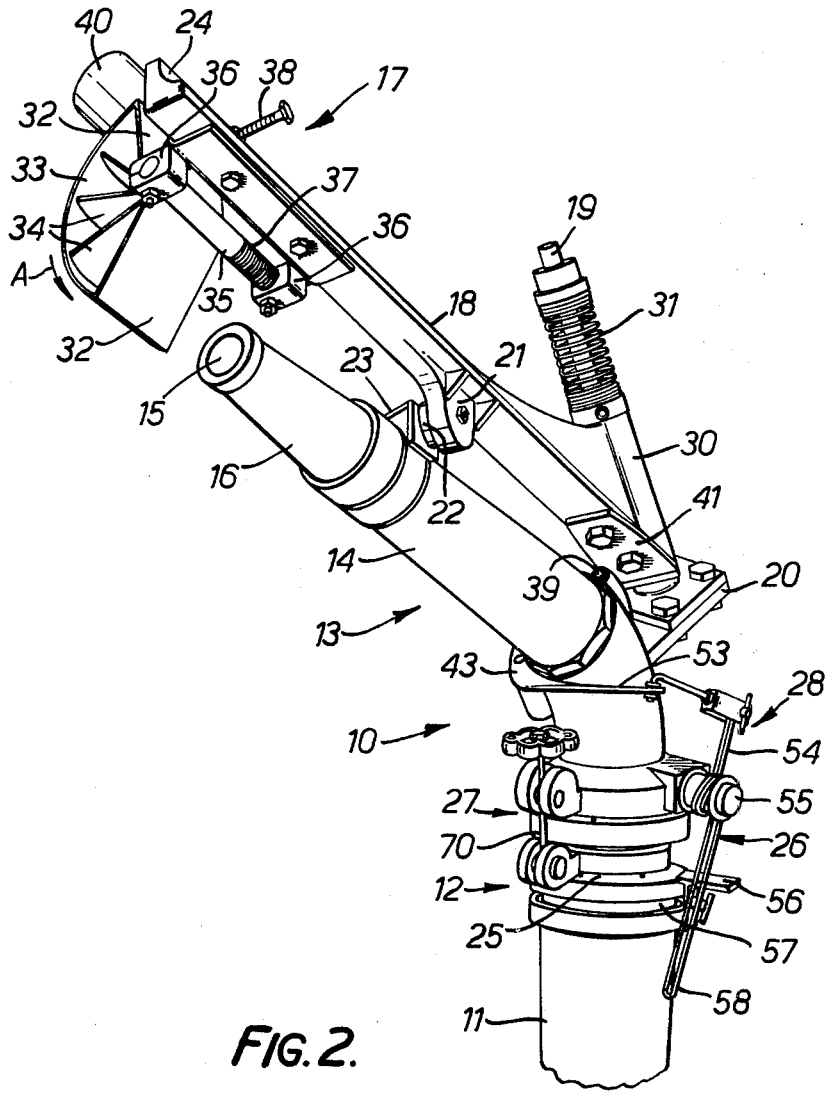
FIG. 2 is a perspective view of the sprinkler from the opposite side.

As shown in the drawings, the sprinkler 10 includes a normally upstanding fixed supply housing 11 incorporating a pivot assembly 12 for sealably securing thereto, in rotatable manner for rotation about a normally vertical support axis, the outlet nozzle assembly 13. In use, water under pressure is fed into the supply housing through the pivot assembly 12, out through the nozzle assembly 13 which includes an elongate straight run venturi portion 14 in which there is provided an inwardly extending vane for ensuring coherent flow through the outlet 15 of the nozzle proper 16 so that the water jet does not disperse immediately upon discharge. The nozzle 16 is removable so nozzle sizes can be varied.

In this embodiment, the venturi portion is manufactured of aluminium alloy and is screwed to the base portion of the outlet nozzle assembly 13. A stainless steel liner is provided for the venturi portion and is roll formed into frustoconical form having a longitudinal seam formed by inturned flanged edges which abut flush against one another when disposed operatively in the venturi portion. These inturned flanges form a straight vane extending longitudinally along the inner surface of the venturi portion 14 and serve to straighten the water flow to ensure coherent flow from the nozzle 16.

A feature of this invention is the provision of adjustable flow deflecting means 17 mounted at the free end of the support arm 18 which, in turn, is rotatable about an inclined upwardly extending axle 19 fixed at its lower end to a support flange 20 rigid with the outlet nozzle assembly 13 for rotation therewith. The support arm 18 is provided with a downwardly extending abutment lug 21 on which a rubber cushion pad 22 is mounted for co-action with a bracket 23 fixed to the nozzle assembly 13. The axle 19 supporting the support arm 18 is arranged so that the arm 18 is normally urged by gravity, and by adjustable spring means if desired, into contact through the rubber cushion pad 22 with the nozzle bracket 23.

The arrangement of the support arm and flow deflecting means is such that impingement of the water jet against the flow deflecting means causes the water jet to deflect sideways so that in sequence, the nozzle 16 will pivot clockwise about its vertical pivot axis due to the reaction caused by the deflection of the water jet and the outer end 24 of the arm 18 supporting the deflecting means 17, and the arm 18, will be pivoted anti-clockwise up and away from the outer end of the nozzle 16. Such actions will cause the deflecting means 17 to move out of engagement with the water jet, whereafter the free end 24 will be urged by gravity and possibly by spring means, depending on the adjustment thereof, back towards the nozzle 16 and again into engagement with the water jet. Thus, the nozzle assembly 13 will pivot clockwise in small increments about the vertical support axis.

As so far described, the nozzle 17 would in operation rotate about the vertical support axis in small increments so that a circular spray pattern would be achieved. However, as illustrated in the drawings, control means 28 are provided to selectively limit the sector of the circle in which the nozzle assembly 13 will operate. The arrangement is such that when the nozzle assembly 13 has moved through its selected sector, it returns automatically to repeat indefinitely its spraying action within the selected sector. In the basic assembly, there is also provided an auxiliary nozzle 39 situated at the base of the nozzle 16 and adapted to spray water to the inner part of the sector not covered sufficiently by the main nozzle 16.

As illustrated, the support arm assembly 18 is mounted about an upstanding axle 19 fixed rigidly to the base of the nozzle assembly 13. For this purpose, the inner end of the support arm 18 is provided with a bearing tube 30 which is mounted freely rotatable about the axle 19. An adjustable coiled torsion spring 31 having its lower end fixed to the bearing tube 30 and its upper end fixed adjustably to the axle 19 is provided and adapted when suitably adjusted to urge the support arm 18 in a direction towards engagement with the nozzle assembly 13. Furthermore, the axle 19 is tilted obliquely with respect to the spray pivot axis so that gravitational force will urge the pivot arm 18 into engagement with the nozzle assembly 13.

As shown, the flow deflecting means 17 is supported pivotally at the outer end 24 of the support arm 18 on a shaft 35 which extends between two mounting lugs 36 fixed at spaced positions to the outer end 24 of the arm 18. The shaft 35, when said arm is disposed in contact with the nozzle 16, extends in the general direction of the discharge axis of the nozzle 16 but is slightly angled thereto. The flow deflecting means 17 comprises a frame in the form of a sector of a cylinder having end plates 32 extending radially from the pivot shaft 35 and supporting therebetween an outer part cylindrical deflecting plate 33 and intermediate drive vanes 34 extending substantially radially inwardly from said deflecting plate, and a concave reversing spoon 40 is fixed substantially tangentially to the trailing end of the deflecting plate 33.

The part cylindrical deflecting plate 33 is mounted such that the cylinder axis extends outwardly across the jet stream from the side of the nozzle 16 opposite the cushion pad 22 to the opposite side of the nozzle 16. Thus, upon engagement of the plate 33 with the water jet, the latter is deflected in a sideways direction, substantially in the direction of the cylinder axis, thus maintaining contact, through pad 22, between the arm 18 and the nozzle assembly 13. The nozzle assembly 13 reacts by pivoting in a clockwise direction when viewed from above. Such reaction continues while the deflecting plate remains in the jet stream and in operation, this time will depend, among other things, on the number of drive vanes that will be placed initially in contact with the jet stream.

The drive vanes 34 are in operation urged into engagement with the water jet and each has a portion which is angled thereto so that upon impingement of the water jet thereagainst they are urged in a tangential direction with respect to the shaft 35 out of engagement with the water jet causing rotation of the deflecting means 17 about its pivot mounting shaft 35. A coiled torsion spring 37 is disposed about the shaft 35 and is interposed between the deflecting means 17 and the support arm 18 and arranged to urge the deflecting means 17 in a direction opposing its rotation due to engagement between the jet stream and the drive vanes 34. The coiled torsion spring 37 may be adjustable so that the ease of pivoting may be varied as desired. Alternatively, the deflecting means may be free to pivot under the influence of gravity and be arranged to pivot upwards by engagement between the vanes and the water jet. There is also provided an adjustable stop screw 38 which screws through the outer end 24 of the arm 18 and engages against the upper radial end plate 32. Adjustment of this stop screw 38 pivots the deflecting means 17 about the axle 35 so that the number of drive vanes 34 that will come into contact with the jet stream may be varied.

In the illustrated embodiment, three drive vanes 34 are provided and upon engagement with the water jet they rotate the deflecting means 17 downwards in the direction indicated by the arrow A bringing the concave reversing spoon 40 into engagement with the jet stream.

If the deflecting means 17 is pivoted downwards by the stop screw 38 so that only one drive vane 34 will come into contact with the water jet, then only a small portion of the deflecting surface will contact the jet stream so that the reaction time will be short. This reaction continues until the deflecting means 17 is rotated in direction A far enough to bring the reversing spoon 40 into contact with the water jet. This spoon 40 has a lead in portion parallel to the discharge axis of the water jet and tangential to the plate 33. The spoon then curves outwards in a manner causing deflection of the jet stream in the reverse direction to that caused by the plate 33, thus causing the arm 18 to be flung anti-clockwise pivotally sideways, up and away from the nozzle 16 as previously described. The return spring 37 pivots the deflecting means 17 back into contact with the stop screw and upon return of the arm 18 the selected drive vanes 34 are again contacted with the water jet and the process is repeated so that the nozzle is rotated in a clockwise direction in small increments.

The sprinkler 10 has in-built friction means provided so that the relative ease of pivoting between arm 18 and the nozzle 16 is such that the arm 18 reacts to impingement of the water jet against the spoon 40 more violently than the nozzle assembly 13. However, the nozzle assembly 13 does react to a small extent causing it to rotate a small amount in an anti-clockwise direction at the end of its incremental rotation. This rotation is only small but is sufficient to give the jet spray a sharp change in direction, thus effectively dispersing the water. Of course, if the stop screw 38 is adjusted so that all drive vanes 34 come into contact with the jet stream, then the time the deflecting surface remains in contact with the water jet will be increased and the nozzle will rotate in larger increments thus achieving a higher average rotational speed. This speed may also be adjusted by varying the effect of the return spring 31 mounted between the arm 18 and the axle 19 as well as the effect of the return spring 37 mounted between the arm 18 and the deflecting means 17.

As mentioned previously, there are provided control means 28 to control the pivotal action of the nozzle assembly 13 about the vertical spray axis. As shown, a stainless steel abutment member 41 is bolted to the lower face of the bearing tube 30 and arm 18 for rotation therewith. The abutment member 41 is adapted to co-operate with an eccentric stop 42 mounted at the free end of a reversing link arm 43 which is pivotally mounted to the lower portion of the nozzle assembly 13 by means of an axle 44 fixed thereto and extending pivotally through an apertured bush 45 rigid with the assembly 13. The reversing link arm 43 is adapted to be pivoted from an engaged position as illustrated in FIG. 1 in which the eccentric stop 42 is positioned adjacent the complementary abutting surface 46 of the abutment member 41, to a disengaged position in which the eccentric stop 42 is positioned clear of the abutment member 41.

The link arm 43 is biased towards either position by an over-center assembly 47 which maintains the link arm 43 in either selected position and comprises a shaft 48 connected pivotally to the eccentric stop axle 49 and passing through the apertured upper end 50 of an axle 51 mounted pivotally in spaced relationship to the link arm axle 44 in a bush fixed to the assembly 13. A spring 52 is interposed between the axle 51 and the eccentric shaft mounting end of the shaft 48 so that when the eccentric stop 42 is in either engaged or disengaged position it is maintained in that position by the spring 52. The opposite end 53 of link arm 43 is connected to a striker arm 54 which is mounted pivotally intermediate its ends about a horizontally extending axle 55 fixed to the lower portion of the outlet nozzle assembly 13. The striker arm extends downwardly from its connection with the end 53 of the link arm 43 and is adapted to engage with selectively positionable outwardly extending limit bars 56 which locate in a recess extending around the fixed supply housing 11. The striker arms 54 may be located at any point around the recess 57 and a pair of striker arms 56 is normally provided to determine the opposite limits of the sector of operation of the spray nozzle assembly 13.

In operation, when the nozzle assembly 13 is rotating operatively in small increments around the vertical spray axis, the eccentric stop 42 is held clear of the abutment member 41 by the over-center assembly 47. The nozzle 16 continues to rotate in a clockwise direction when viewed from above until the lower end of the striker arm 54 makes contact with a stop bar 56. Further rotation of the nozzle 16 will cause the striker arm 54 to pivot about its horizontal axle 55 which, in turn, through its upper connection with the link arm 43, will pivot the latter so as to move the eccentric stop 42 from its disengaged position to its engaged position. The positioning of the eccentric stop in the engaged position will prevent the support arm 18 from pivoting away from the nozzle assembly 13 because of the engagement between the abutment member 41 and the eccentric stop 42 so that when the reversing spoon 40 next comes into contact with the jet stream, the support arm 18 and the outlet nozzle assembly 13 will pivot in unison in the reverse direction, i.e., anti-clockwise when viewed from above, until the lower end 58 of the striker bar 54 contacts the previously remote limit bar 56. Such engagement will cause the striker arm to pivot to its previous attitude in which the eccentric stop 42 is out of engagement with the surface 46 of the abutment member 41. The outlet nozzle will then again resume its normal rotation in small increments.

The eccentric stop 42 is provided so that the clearance between the abutting surface 46 of the abutment member 41 and the stop 42 may be varied. If the eccentric stop is adjusted so that the largest gap is provided, then the support arm 18 will pivot about its axle 19 until the abutting surface 46 contacts the eccentric stop 42. Thus, during the reverse cycle, only the outer portion of the reversing spoon will contact the water jet so that the speed of rotation in the reverse direction will be relatively slow. On the other hand, if the eccentric stop 42 is adjusted so that no clearance exists between the abutting surface 46 and the stop 42, then during the reverse cycle, the whole of the reversing spoon will be maintained in the water jet and the reversing speed will be relatively fast. Of course, adjustment of the eccentric stop between the above illustrated limits will provide an infinite adjustment of the reversing speed between its upper and lower limits.

The abutment member 41 is provided with a second abutting surface 59 which is adapted to engage against an upstanding lug to limit the rearward movement of the support arm 18. Suitably, this lug may be apertured as at 60, which aperture may be aligned with a tapped aperture in the lower portion of the outlet nozzle assembly 13 when the arm 18 is remote from the jet stream. Thus, an operator may insert a bolt through the aperture 60 into the tapped aperture to locate the arm in a position remote from the jet stream so that no rotation of the outlet nozzle assembly 13 may take place.

Additionally, the outer end 24 of the arm 18 may be provided with an adjustable stream engaging shock absorbing skid. This skid would be mounted in such manner that it could be adjusted into engagement with the jet stream and angled thereto so that it would contact the jet stream prior to the cushion pad 22 contacting the bracket 27. Such action would substantially reduce the rotational speed of the pivot arm prior to it engaging against the bracket 27 and thus ensuring a longer life therefor. Suitably, the skid could be formed as an eccentric member such that its engagement of the water jet could be easily varied.

Figure 3:
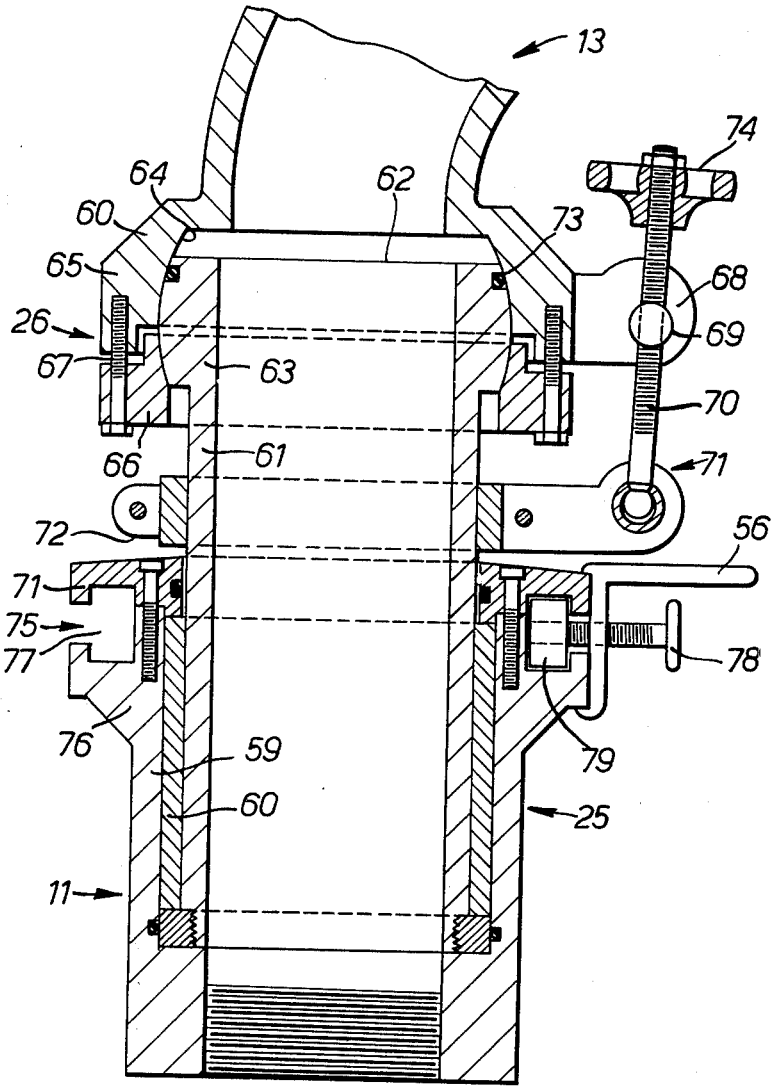
FIG. 3 is a cross-sectional view through the body of the sprinkler illustrating the general construction details.
Figure 4:
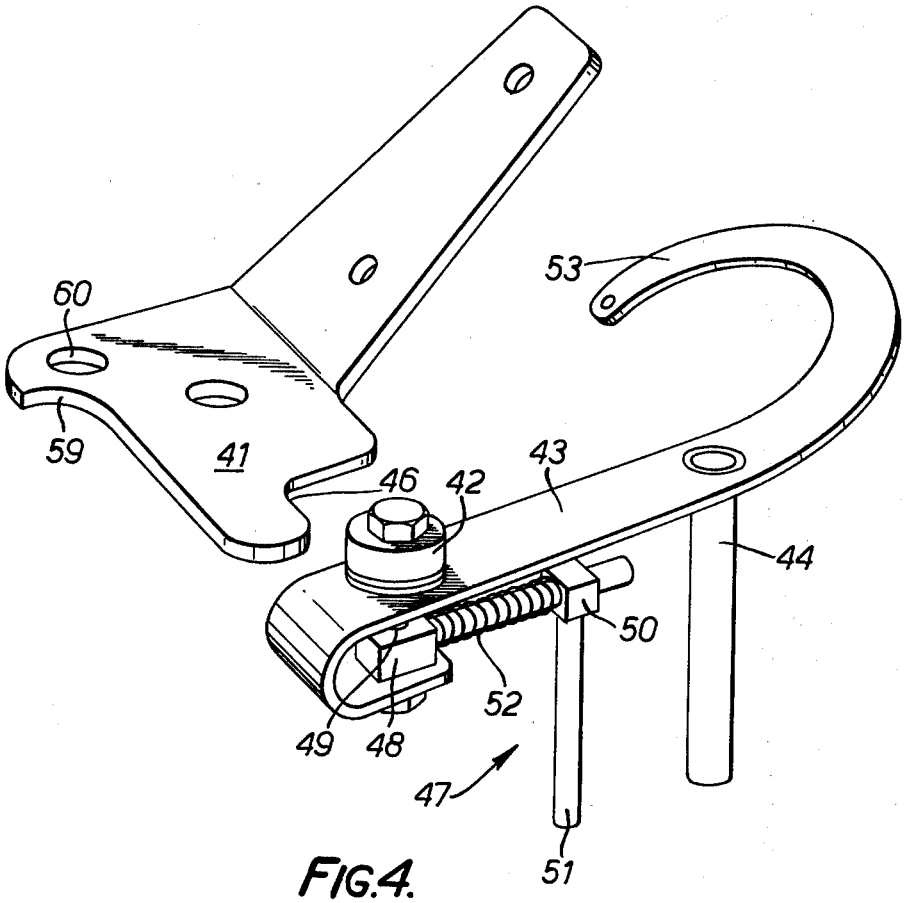
FIG. 4 is a partly exploded perspective view of the cam return mechanism of the illustrated embodiment.

As shown in FIG. 3, the upstanding portion of the sprinkler 10 comprises the lower supply housing 11 which is threaded internally for connection to the water supply and which provides a cylindrical bearing surface 59 for housing a synthetic cylindrical bearing 60 supporting a pivot tube 61. The fit between these parts is tight so that a relatively large force is needed to rotate the pivot tube 11. The latter is provided at its upper end 62 with a part-spherical ball portion 63 which is adapted to co-act with a complementary inner spherical socket 64 formed in the lower mounting portion 65 of the outlet nozzle assembly 13 only the lower portion of which is illustrated.

The socket 64 is retained in engagement with the ball portion 63 by a lower retaining ring 66 which has a part-spherical inner surface and which is connected to the mounting portion 65 by screws 67. The ring 66 is disposed diametrically opposite the socket 64 about the ball portion 63. The mounting portion 65 is provided with a pair of outwardly extending brackets 68 which support therebetween a threadedly apertured pin 69 through which a manually rotatable threaded shaft 70 extends and engages rotatably with a retaining assembly 71 provided on a split sleeve 72, which extends around the pivot tube between the supply housing 11 and the retaining ring 66. It will be seen that rotation of the threaded shaft 70 will cause the lower mounting portion, and thus the outlet nozzle assembly 13 to pivot sealably about the ball portion 63. In this case there is provided an O-ring 73 to maintain a seal between the ball portion 63 and the lower mating socket 65. Thus, the trajectory of the jet spray may be varied by rotation of the hand wheel 74 fixed to the shaft 70.

The upper end 75 of the supply housing 11 is provided with a recessed flange 76 which is adapted to co-act with a similar recess in a retaining ring 77 to provide the peripherally extending recess 77 operative for retaining nuts 79 of the limit bars 56. As shown, the latter may be moved to any position around the recess 77 by slackening the thumb-screw 78, moving the stop bar to the desired position and re-tightening the thumb screw 78. The limit bars may be spaced as desired, defining between them the sector of the spray circle in which the nozzle assembly 13 will operate.

It will of course be realised that many modifications of constructional detail and design may be made to the above described embodiment such as by addition, deletion or alteration, and all such modifications as would be apparent to persons skilled in the art are deemed to fall within the broad scope and ambit of the present invention as is defined in the appended claims.

I claim:

1. A sprinkler of the type having a water inlet housing supporting an outlet nozzle assembly thereon for pivotal movement about a substantially vertical support axis in such manner that water supplied to said housing is discharged through said outlet nozzle assembly as a water jet having a discharge axis inclined to said support axis and a flow deflecting assembly adapted for intermittent engagement with said water jet to cause incremental rotation of said outlet nozzle assembly about said support axis, characterized in that said flow deflecting assembly includes a support structure and flow deflecting means supported thereby for movement between an engaged position in which said deflecting means engages said water jet to deflect said jet to one side of said nozzle to maintain said flow deflecting assembly in said engaged position and cause said nozzle to pivot about its support axis in the forward direction, and a disengaged position in which said deflecting means is disposed remote from said water jet, said flow deflecting means including a deflecting blade assembly having a forward deflecting face engageable with said water jet so as to cause said forward pivoting of said outlet nozzle assembly and a reverse-deflecting face engageable with said water jet to cause deflection thereof for deflecting said water jet to the other side of said nozzle to cause said flow deflecting assembly to move to said disengaged position and driving vane means associated with said deflecting blade assembly and adapted to engage said water jet simultaneously with said deflecting blade assembly to move the latter through said water jet, the parts being so made and arranged that said forward-deflecting face is arranged at the leading end of said deflecting assembly and said reverse-deflecting face is disposed at the trailing end of said deflecting blade assembly, whereby engagement between said reverse-deflecting face and said water jet subsequent to engagement between said water jet and said forward-deflecting face causes said disengagement between said flow deflecting assembly and said water jet.

2. A sprinkler according to claim 1, characterized in that said driving vane means includes a plurality of spaced-apart vanes arranged to sequentially engage said water jet upon movement of said deflecting blade assembly through said water jet and there being provided vane adjustment means operable to vary the number of vanes which will in operation engage said water jet whereby the time of engagement between said deflecting means and said water jet may be varied.

3. A sprinkler according to claim 1, characterized in that said support structure includes a pivot arm supported for pivotal movement on said nozzle assembly about an upwardly extending axis, said pivot arm when supporting said deflecting means in said engaged position being restrained against forward rotation relative to said outlet nozzle assembly whereby when said deflecting means is in said engaged position said pivot arm and said outlet nozzle rotate in unison in a forward direction about said support axis, and said pivot arm being free to pivot relative to said nozzle assembly in the reverse direction to said disengaged position upon engagement between said water jet and said reverse-deflecting face.

4. A sprinkler according to claim 2, wherein said deflecting blade assembly includes a forwardly-deflecting part formed as a sector of a cylinder and supported pivotally about a sector axis which extends substantially parallel to the cylinder axis and substantially in the direction of said discharge axis and wherein said driving vanes extend between said axis and said deflecting blade and are arranged to deflect a portion of said water jet in a direction tangential to said sector axis so as to cause said deflecting blade assembly to pivot about said sector axis.

5. A sprinkler according to claim 3, wherein there is provided selectively engageable lock means operable to prevent said pivot arm pivoting in said reverse direction relative to said nozzle assembly, whereby in operation when said reverse-deflecting face is engaged with said water jet said reverse deflection of said water jet will cause said nozzle assembly and said pivot arm to pivot in unison about said support axis in the reverse direction.

6. A sprinkler according to claim 5 wherein said lock means is engaged by co-action, resultant from forward rotation of said nozzle assembly, with a selectively positionable first stop member mounted on said inlet housing and wherein said lock means is adapted to be disengaged upon co-action, resultant from reverse rotation of said nozzle assembly, between said nozzle assembly and a second selectively positionable stop member mounted on said inlet housing such that the relative positions of said first and second stop members determines the sector of operation of said sprinkler.

7. A sprinkler according to claim 5, wherein said lock means is adjustable so as to provide limited movement of said pivot arm away from said nozzle assembly in said reverse direction, whereby in operation said reverse-deflecting face may move part-way out of engagement with said water jet so as to reduce the reaction between said face and said jet and the speed of second reverse rotation.

8. A sprinkler according to claim 7, wherein said lock means includes an abutment member mounted on said outlet nozzle and movable between a locked position and an unlocked position, said abutment member when in said locked position being spaced from the pivot mounting of said pivot arm and adapted when the latter is disposed in said engaged position to interfere with said pivot arm in such manner as to prevent pivotal movement of the latter relative to said outlet nozzle assembly.

9. A sprinkler according to claim 8 wherein said abutment member is associated with a linkage assembly supported on said outlet nozzle assembly, said linkage assembly including contact means adapted upon rotation of said outlet nozzle assembly to co-act with a respective one of said stop members to move the abutment member in the respective direction to its locked or unlocked position.

10. A sprinkler according to claim 3, wherein said pivot arm is pivoted at its end remote from said deflecting means about an upwardly extending pivot axis disposed adjacent to said support axis and inclined thereto in such manner that during pivotal movement of said pivot arm from said engaged position to said disengaged position, said free end moves sideways and upwards so as to be biased by gravity towards said engaged position.

11. A sprinkler according to claim 10, wherein an adjustable biasing spring means is connected between said pivot arm and said nozzle assembly and adjustable to urge said pivot arm towards said engaged position.

12. A sprinkler according to claim 1, wherein said inlet housing supports said outlet nozzle assembly by means of a ball and socket joint and there being provided adjustment means interposed between said ball and said socket whereby the angle between said support axis and said discharge axis may be selectively varied.

* * * * *